US006857423B2

(12) United States Patent
Jong

(10) Patent No.: US 6,857,423 B2
(45) Date of Patent: Feb. 22, 2005

(54) PAINTBALL MARKER AND KIT OF PARTS THEREFOR

(76) Inventor: Paul Garfield Jong, 1661 Dennison Street, Markham, Ontario (CA), L3R 0N5

( * ) Notice: Subject to any disclaimer, the term of this patent is extended or adjusted under 35 U.S.C. 154(b) by 0 days.

(21) Appl. No.: 10/361,766

(22) Filed: Feb. 11, 2003

(65) Prior Publication Data

US 2004/0154600 A1 Aug. 12, 2004

(51) Int. Cl.[7] ..... F41B 11/00
(52) U.S. Cl. ..... 124/74; 124/74
(58) Field of Search ..... 124/74, 56, 71, 124/72, 73, 75, 76, 77

(56) References Cited

U.S. PATENT DOCUMENTS

| | | | | |
|---|---|---|---|---|
| 5,282,454 A | | 2/1994 | Bell et al. | |
| 5,613,483 A | | 3/1997 | Lukas et al. | |
| 5,634,456 A | | 6/1997 | Perrone | |
| 5,640,945 A | | 6/1997 | Slonaker et al. | |
| 5,727,538 A | | 3/1998 | Ellis | |
| 5,809,983 A | | 9/1998 | Stoneking | |
| 5,816,232 A | | 10/1998 | Bell | |
| 5,823,173 A | | 10/1998 | Slonaker et al. | |
| 5,878,736 A | | 3/1999 | Lotuaco, III | |
| 5,881,707 A | | 3/1999 | Gardner, Jr. | |
| 5,954,042 A | | 9/1999 | Harvey | |
| 5,967,133 A | | 10/1999 | Gardner, Jr. | |
| 6,003,504 A | * | 12/1999 | Rice et al. | 124/73 |
| 6,035,843 A | | 3/2000 | Smith et al. | |
| 6,065,460 A | | 5/2000 | Lotuaco, III | |
| 6,138,656 A | * | 10/2000 | Rice et al. | 124/73 |
| 6,213,110 B1 | | 4/2001 | Christopher et al. | |
| 6,311,682 B1 | | 11/2001 | Rice et al. | |
| 6,343,599 B1 | | 2/2002 | Perrone | |
| 6,349,711 B1 | | 2/2002 | Perry et al. | |
| 6,360,736 B1 | * | 3/2002 | Juan | 124/77 |
| 6,439,217 B1 | | 8/2002 | Shih | |
| 6,470,872 B1 | | 10/2002 | Tiberius et al. | |
| 6,474,326 B1 | | 11/2002 | Smith et al. | |
| 6,561,176 B1 | * | 5/2003 | Fujimoto et al. | 124/76 |
| 6,637,420 B2 | * | 10/2003 | Moritz | 124/73 |
| 2001/0042543 A1 | * | 11/2001 | Perrone | 124/77 |
| 2002/0170552 A1 | | 11/2002 | Gardner, Jr. | |
| 2003/0168052 A1 | * | 9/2003 | Masse | 124/73 |

FOREIGN PATENT DOCUMENTS

| | | | |
|---|---|---|---|
| WO | WO 00/75594 A1 * 12/2000 | ..... | F41B/11/02 |

* cited by examiner

*Primary Examiner*—Teri P. Luu
*Assistant Examiner*—Jordan Lofdahl
(74) *Attorney, Agent, or Firm*—Bereskin & Parr

(57) ABSTRACT

A paintball marker is provided including a body, a bolt and an actuator. The body defines a chamber having a paintball inlet. The bolt is slideable within the chamber between an open position wherein the bolt permits the entry of a paintball through the paintball inlet into the chamber, and a closed position wherein the bolt prevents the entry of a paintball through the paintball inlet into the chamber. The actuator is operatively connected to the bolt. The actuator is adapted to apply an opening force to move the bolt towards the open position and a closing force to move the bolt towards the closed position. The closing force is different from the opening force.

24 Claims, 10 Drawing Sheets

PAINTBALL MARKER AND KIT OF PARTS THEREFOR

FIELD OF THE INVENTION

The present invention relates to paintball markers and more particularly to chambering of paintballs in paintball markers.

BACKGROUND OF THE INVENTION

Many people today enjoy playing paintball games with sophisticated paintball markers. A typical paintball marker has a chamber from which paintballs are fired. A paintball tube communicates with the chamber, and holds paintballs for feeding into the chamber. A bolt slides within the chamber and controls the entry of paintballs from the paintball tube into the chamber. The bolt is typically moved between an open position whereby a paintball is permitted to enter the chamber and a closed position whereby the entry of paintballs into the chamber is prevented. A pneumatic actuator is typically used to move the bolt.

If a paintball does not feed correctly in the chamber, the bolt can squash and rupture the paintball, releasing paint onto the interior mechanisms of the marker. As a result, the released paint can disrupt the proper functioning of the marker. Consequently, after a paintball is squashed inside a marker, it is usually required for the marker to be disassembled and cleaned to remove any paint on the interior mechanisms.

There is, therefore, a continuing need for paintball markers that have a reduced tendency to squash and rupture paintballs contained therein.

SUMMARY OF THE INVENTION

In a first aspect, the present invention is directed to a paintball marker including a body, a bolt and an actuator. The body defines a chamber having a paintball inlet. The bolt is slideable within the chamber between an open position wherein the bolt permits the entry of a paintball through the paintball inlet into the chamber, and a closed position wherein the bolt prevents the entry of a paintball through the paintball inlet into the chamber. The actuator is operatively connected to the bolt. The actuator is adapted to apply an opening force to move the bolt towards the open position and a closing force to move the bolt towards the closed position. The opening force is different from the closing force.

In a second aspect the present invention is directed to an actuator for a paintball marker. The paintball marker includes a body that defines a chamber. The chamber has a paintball inlet. The paintball marker further includes a bolt that is slideable within the chamber between an open position wherein the bolt permits the entry of a paintball through the paintball inlet into the chamber and a closed position wherein the bolt prevents the entry of a paintball through the paintball inlet into the chamber. The paintball marker further includes a pneumatic cylinder that is operatively connected to the bolt. The actuator comprises a control valve. The control valve is positionable in a first control valve position wherein the control valve is adapted to transmit gas at a first pressure to the pneumatic cylinder for driving the bolt towards the open position. The control valve is also positionable in a second control valve position wherein the control valve is adapted to transmit gas at a second pressure to the pneumatic cylinder to drive the bolt towards the closed position. The second pressure is different from the first pressure.

In a preferred embodiment of the second aspect, the paintball marker includes a first regulator, and the actuator includes a second regulator. The first regulator is fluidly connectable to a pressurized gas source and is adapted to provide gas at the first pressure. The second regulator is fluidly connectable to the pressurized gas source and is adapted to provide gas at the second pressure.

In a third aspect, the present invention is directed to a method for controlling the flow of paintballs through a paintball inlet into a chamber that is defined in a body of a paintball marker. The paintball marker includes a bolt that is slideable within the chamber. The method comprises:

applying an opening force to the bolt to move the bolt to an open position to permit the entry of a paintball through the paintball inlet into the chamber; and applying a closing force to the bolt to move the bolt to a closed position to prevent the entry of a paintball through the paintball inlet into the chamber, wherein the closing force is different from the opening force.

In a fourth aspect, the present invention is directed to a paintball marker including a body, a bolt, a pneumatic cylinder and a control valve. The body defines a chamber that has a paintball inlet. The bolt is slideable within the chamber between an open position wherein the bolt permits entry of a paintball through the paintball inlet into the chamber and a closed position wherein the bolt prevents entry of a paintball through the paintball inlet into the chamber. The pneumatic cylinder includes a cylinder housing that has a first cylinder port and a second cylinder port. The pneumatic cylinder further includes a piston that is slideable within the cylinder housing between the first and second cylinder ports. The piston is operatively connected to the bolt. The control valve is for controlling gas flow to the first and second cylinder ports. The control valve is adapted to send gas to the first cylinder port to move the piston in a first direction to move the bolt towards the open position with an opening force. The control valve is adapted to send gas to the second cylinder port to move the piston in a second direction to move the bolt towards the closed position with a closing force. The closing force is sufficiently low as to inhibit rupturing of a paintball if, during use, the paintball is confined by the bolt during movement of the bolt towards the closed position.

In a fifth aspect, the present invention is directed to a paintball marker including a body, a bolt and an actuator. The body defines a chamber that has a paintball inlet. The bolt is slideable within the chamber between an open position wherein the bolt permits entry of a paintball through the paintball inlet into the chamber and a closed position wherein the bolt prevents entry of a paintball through the paintball inlet into the chamber. The actuator is operatively connected to the bolt and is adapted to apply a closing force to move the bolt towards the closed position. The closing force is sufficiently low as to inhibit rupturing of a paintball if, during use, the paintball is confined by the bolt during movement of the bolt towards the closed position.

BRIEF DESCRIPTION OF THE DRAWINGS

The present invention will now be described by way of example only with reference to the attached drawings, in which.

DETAILED DESCRIPTION OF THE INVENTION

Figure 1A:
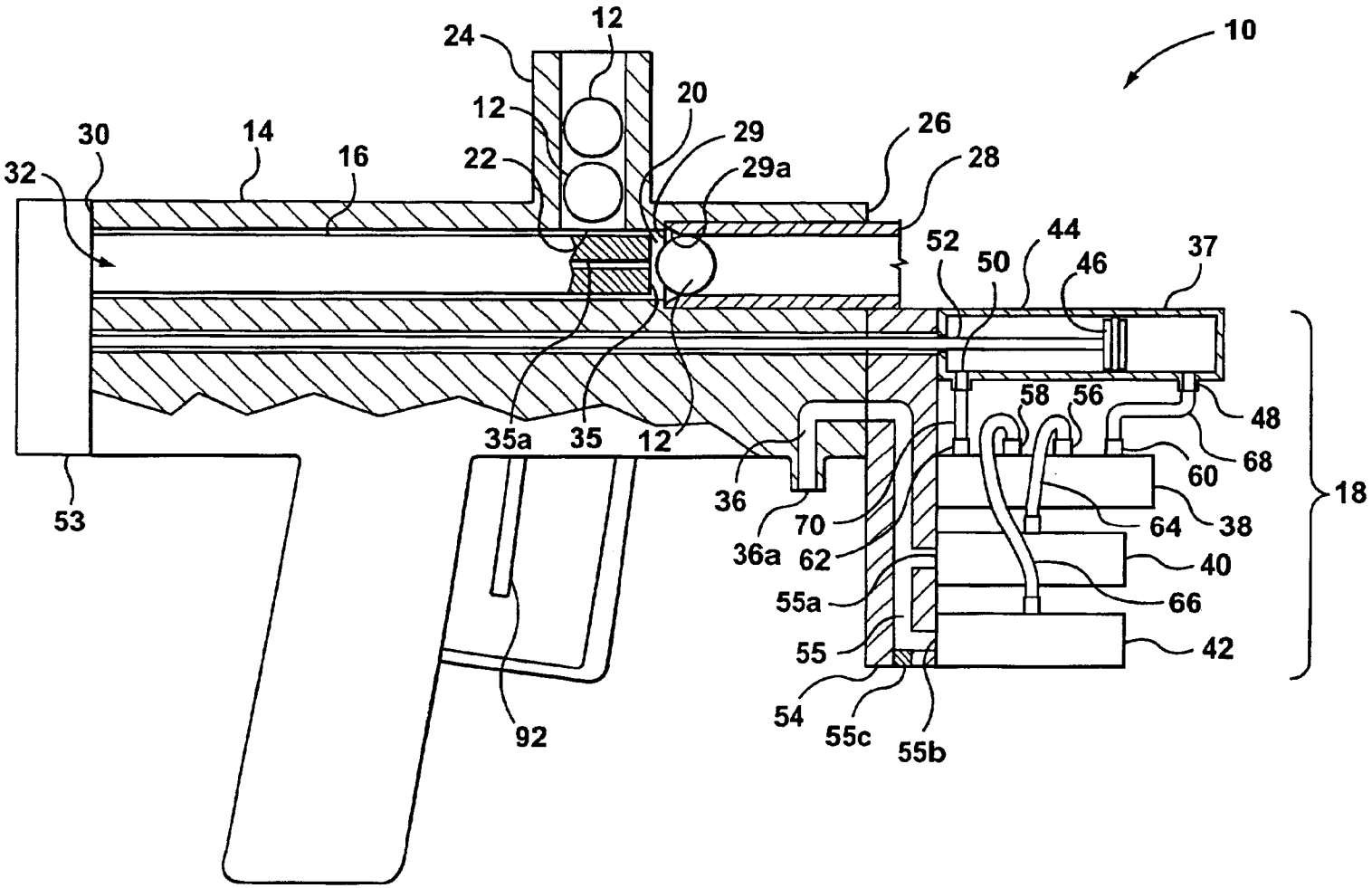
FIG. 1*a* is a partially sectional side view of a paintball marker in accordance with a first embodiment of the present invention, in a bolt-closed position.

Reference is made to FIG. 1*a*, which shows a paintball marker 10 in accordance with a first embodiment of the present invention.

The paintball marker 10 is used to fire paintballs 12 during, for example, a paintball game. For simplicity and greater clarity of the Figures, several of the components of the paintball marker 10 that are involved in the firing of paintballs 12 have not been shown in the Figures.

The paintball marker 10 includes a body 14, a bolt 16, and an actuator 18. The body 14 defines a chamber 20 for holding a paintball 12 to be fired. The chamber 20 has a paintball inlet 22 through which paintballs 12 are fed one at a time for firing. A paintball tube 24 may extend outwards from the body 14 for holding a plurality of paintballs 12 to be fed into the chamber 20. The chamber 20 may extend generally linearly and may have a front end 26, which is open. The chamber 20 has a diameter that is sufficiently large that it does not hamper the movement of the paintball 12 therein.

A barrel 28 may be mounted in the front end 26 in fluid communication with the chamber 20. The barrel 28 may have a diameter that is the same or optionally slightly smaller than the diameter of the paintballs 12. It will be appreciated that the barrel diameter is also smaller than the chamber diameter.

The barrel 28 has an inlet which is shown at 29. The inlet 29 includes a transition portion 29*a* (shown more clearly in FIG. 1*b*), which smoothly transitions from the diameter of the chamber 20 to the diameter of the barrel 28.

Figure 1B:
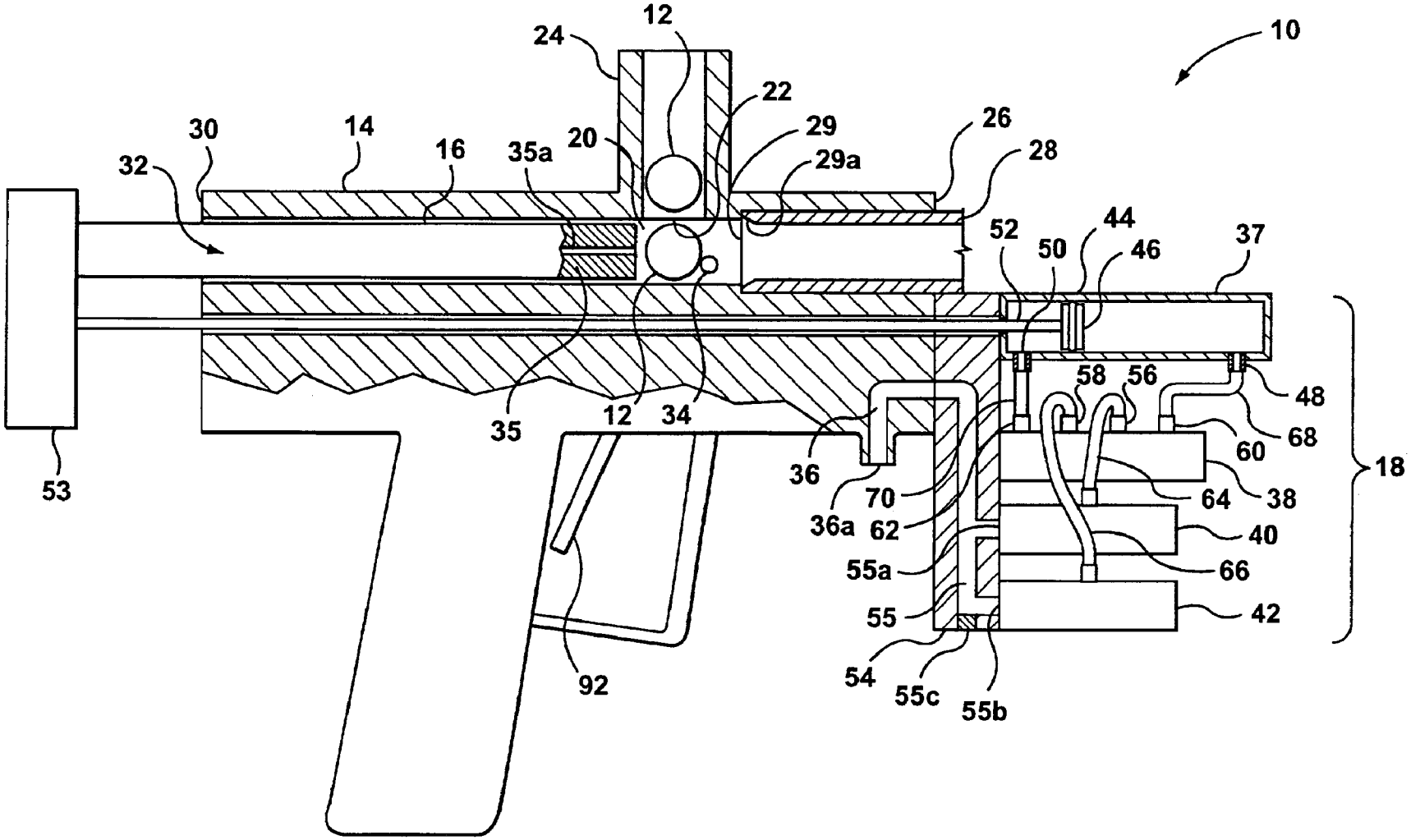
FIG. 1*b* is a partially sectional side view of the paintball marker shown in FIG. 1*a*, in a bolt-open position.

The chamber 20 has a rear end 30 in which there is an opening 32. The bolt 16 is slideable within the chamber 20 and connects to the actuator 18 through the opening 32. The bolt 16 is moveable by means of the actuator 18, between a closed position, as shown in FIG. 1*a* and an open position, as shown in FIG. 1*b*. When the bolt 16 is in the closed position, a paintball 12 in the chamber 20 is held in position between the forward end of the bolt 16, which is shown at 35, and the inlet 29 of the barrel 28. Because of the snug fit of the paintball 12 in the barrel 28, the paintball is prevented from rolling out of the barrel 28 prior to firing of the paintball marker 10. In the embodiment shown in FIG. 1*a*, the paintball 12 is positioned only partially in the barrel 28 when the bolt 16 is in the closed position. It is alternatively possible, however, to have an embodiment (not shown), wherein the bolt 16 pushes the paintball 12 further into the barrel 28 prior to firing of the marker 10.

In addition to retaining the paintball 12 in place in the chamber 20, the bolt 16 also blocks the paintball inlet 22, and prevents other paintballs 12 from entering the chamber 20, when in the closed position shown in FIG. 1*a*. An outlet 35*a* is provided in the forward end 35 of the bolt 16, for pressurized air. When the paintball marker 10 is fired, pressurized air exits through the outlet 35*a* to fire the paintball 12 through the barrel 28 and out of the marker 10.

Reference is made to FIG. 1*b*, which shows the paintball marker 10 in the bolt-open position. When the bolt 16 is in the open position, the bolt 16 does not block the paintball inlet 22, and thus permits the entry of a paintball 12 into the chamber 20. As shown in FIG. 1*b*, when in the open position, the bolt 16 may extend outwards from the chamber 20 through the opening 32.

When in the open position, the front end 35 of the bolt 16 may be positioned generally aligned with the rearmost edge of the paintball inlet 22. A detent 34 extends into the chamber 20 proximate the forwardmost edge of the paintball inlet 22. When the bolt 16 is open, the detent 34 and the bolt 16 cooperate to retain one paintball 12 in the chamber in a position to block other paintballs 12 from entering the chamber 20.

The detent 34 is resilient so as to permit the bolt 16 to push a paintball 12 therepast during closure of the bolt 16. The detent 34 may be resilient by any suitable means, such as by being spring loaded.

The detent 34 is shaped so as not to rupture the paintball 12 as it moves therepast. For example the detent 34 may be spherical.

The actuator 18 is used to move the bolt 16 between the open and closed positions. The actuator 18 may be any suitable type of actuator. For example, the actuator 18 may utilize gas pressure from a suitable gas source such as a pressurized air tank (not shown), to drive the bolt 16 between the open and closed positions. The pressurized air tank (not shown) may contain an actuation gas, such as air, at several thousand psi, at least initially. A primary regulator (not shown) may be connected to the air tank to reduce the air pressure of the actuation air down to a pressure suitable for use in firing the paintball marker 10, eg. 150–350 psi. The primary regulator (not shown) may be a single stage regulator, or alternatively may be a dual stage regulator, essentially consisting of two regulators in series to reduce the air pressure in stages down to the firing pressure. The marker 10 includes an air conduit 36 for transporting air from the primary regulator (not shown) through an inlet 36*a*, to the firing mechanism (not shown) and to the actuator 18.

The actuator 18 includes a pneumatic cylinder 37, a control valve 38, a first actuator regulator 40, and a second actuator regulator 42. The pneumatic cylinder 37 includes a housing 44 and a piston 46. Movement of the piston 46 within the housing 44 is controlled by the entry and discharge of air in the housing 44 through a first port 48 and a second port 50. A rod 52 extends from the piston 46 out from the pneumatic cylinder 37 and through the body 14 of the paintball marker 10. The rod 52 connects the piston 46 to a back plate 53, to which the bolt 16 is also connected. By virtue of the connection of the piston 46 to the bolt 16 by means of the rod 52 and the back plate 53, movement of the piston 46 in the housing 44 causes movement of the bolt 16 in the chamber 20.

The first and second actuator regulators 40 and 42 are mounted in fluid communication with the air conduit 36 to receive air from the primary regulator (not shown). More specifically, the paintball marker 10 may include a manifold 54 that has an internal air conduit 55 therein that is in fluid communication with the air conduit 36.

The manifold 54 has a first port 55*a* for connection to the first actuator regulator 40 and a second port 55*b* for connection to the second actuator regulator 42. The manifold 54 may optionally also include a third port 55*c*, which may be used as desired, or which may be plugged when not in use.

The manifold 54 may be a separate component that mounts to the body 16 of the paintball marker 10, or alternatively, the manifold 54 may be integral with the body 16. The manifold 54 may include mounting means for the first and second actuator regulators 40 and 42, for the control valve 38 and for the pneumatic cylinder 37, as shown in FIG. 1*a*. It is alternatively possible, however, for some or all of these components to mount to the body 16 instead of mounting onto the manifold 54.

Pressurized air travels from the air tank (not shown) through the primary regulator (not shown), where it is reduced to the firing pressure. From there the air travels through the air conduit 36 in the body 16, and from the air conduit 36, through the internal air conduit 55 in the manifold 54. From the air conduit 55, the air is distributed to the first and second actuator regulators 40 and 42.

It is alternatively possible, however, for the primary regulator (not shown) to be connected directly into the manifold 54 using the optional port 55*c*, instead of being connected to the air conduit inlet 36*a* on the body 16. In that case, it will be appreciated that the inlet 36*a* on the body 16 would require plugging.

The actuator regulators 40 and 42 reduce the pressure of the air received from the primary regulator (not shown), down to two different outlet pressures. The first regulator 40 may reduce the pressure of the air to between 50–100 psi, and the second regulator 42 may reduce the pressure of the air to between 10–50 psi. The air pressures provided by the regulators 40 and 42 may be selected based on the specific characteristics of the components of the paintball marker 10. For example, if there is significant resistance in the movement of the bolt 16 in the chamber 20, the regulators 40 and 42 may be selected to provide air at higher pressures. Conversely, if for example, the bolt 16 moves with little resistance in the chamber 20 then accordingly, lower pressures may be selected for the first and second regulators 40 and 42.

The control valve 38 controls the movement of the piston 46 by controlling the flow of air from the regulators 40 and 42 to the first and second ports 48 and 50. The control valve 38 includes a first inlet port 56, a second inlet port 58, a first outlet port 60 and a second outlet port 62. The first inlet port 56 is connected to the outlet of the regulator 40 by means of a first conduit 64. The first outlet port 60 is connected to the first port 48 of the pneumatic cylinder 37 by means of a second conduit 68. The second inlet port 58 is connected to the outlet of the regulator 42 by means of a third conduit 66. The second outlet port 62 is connected to the second port 50 of the pneumatic cylinder 37 by means of a fourth conduit 70. The conduits 64, 66, 68 and 70 may be flexible conduits, such as, for example, flexible plastic tubing. Alternatively, they may be rigid or semi-rigid conduits, such as, for example, stainless steel tubing.

When it is desired to move the bolt 16 from the closed position shown in FIG. 1*a* to the open position shown in FIG. 1*b*, the control valve 38 directs air from the first actuator regulator 40 to the first port 48 on the pneumatic cylinder 37. The increase in pressure in the housing 44 in front of the piston 46 drives the piston 46 rearwardly. Because the bolt 16 is connected to the piston 46 by means of the back plate 53 and the rod 52, the bolt 16 is also moved rearwardly as a result of the movement of the piston 46.

When it is desired to move the bolt 16 from the open position shown in FIG. 1*b* to the closed position shown in 1*a*, the control valve 38 directs air from the regulator 42 to the second port 50 on the pneumatic cylinder 37. The increase in air pressure in the housing 44 behind the piston 46 drives the piston 46, and in turn, the bolt 16 forward to the closed position.

Figure 2:
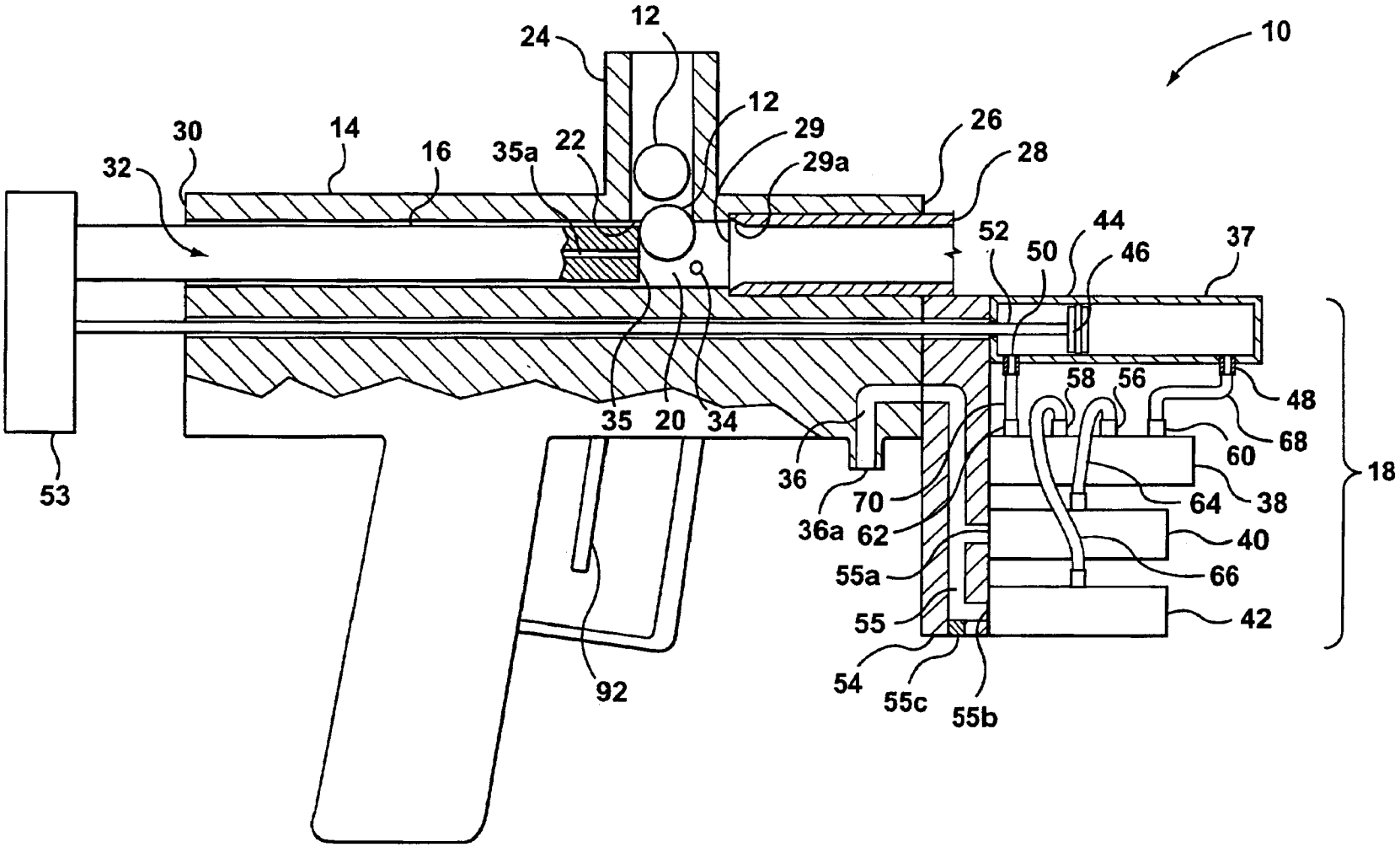
FIG. 2 is a partially sectional side view of the paintball marker shown in FIG. 1*a*, illustrating a mis-feed of a paintball.

Reference is made to FIG. 2. When the bolt 16 is in the open position to permit the entry of a paintball 12 into the chamber 20, it is possible for a variety of reasons for the paintball 12 not to have fully entered the chamber 20 when the bolt moves towards the closed position. In such an instance, the bolt 16 can jam against the mis-fed paintball, pinning the paintball 12 in the paintball inlet 22. Because of the relatively low air pressure and corresponding relatively low force used to drive the piston 46 and the bolt 16 forward, the bolt 16 has a reduced likelihood of rupturing the mis-fed paintball 12 upon jamming there against.

Figure 3A:
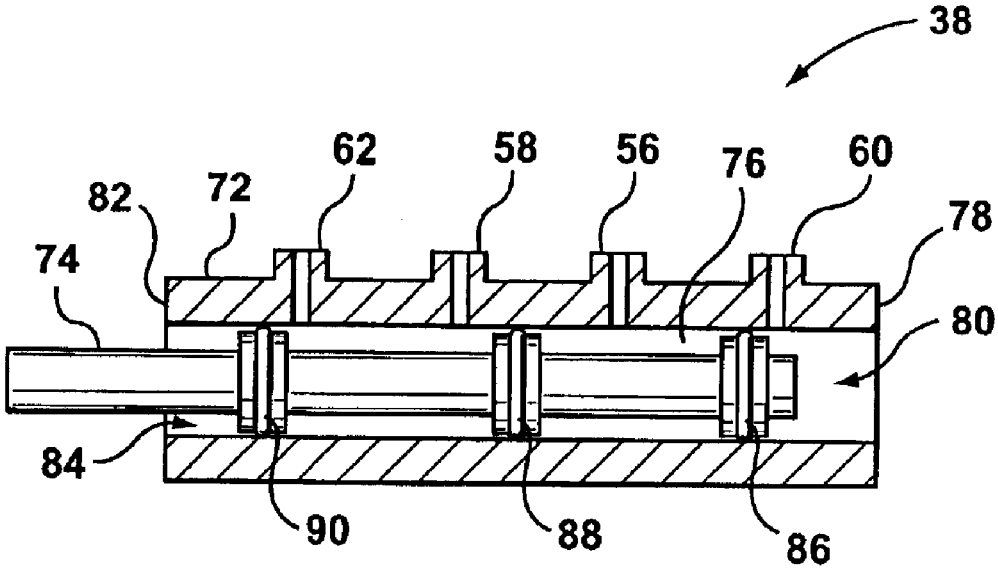
FIGS. 3*a* and 3*b* are magnified sectional side views illustrating the operation of a control valve for the paintball marker shown in FIG. 1*a;*
Figure 3B:
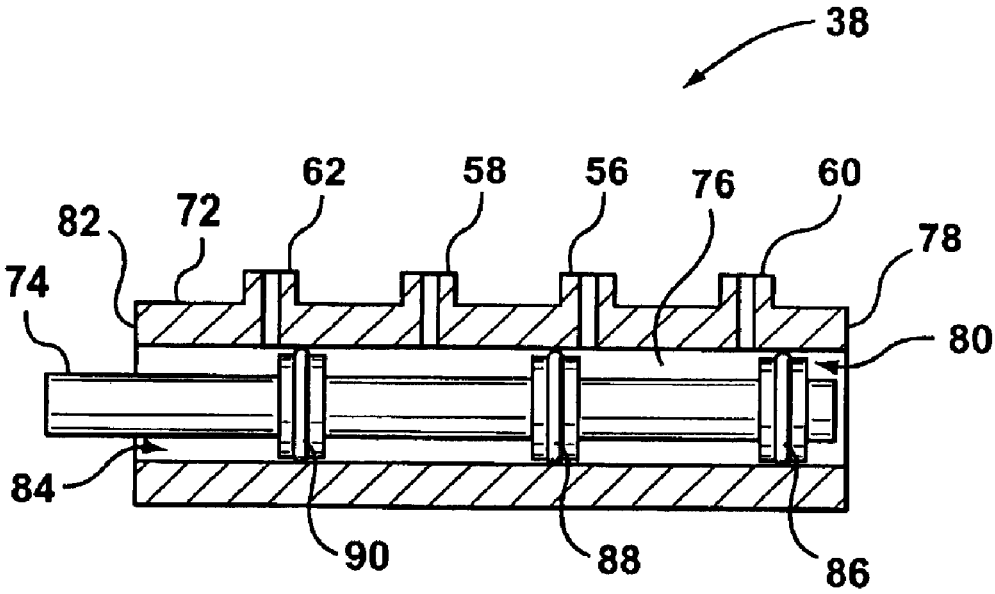

Reference is made to FIGS. 3*a* and 3*b* which show the control valve 38 in more detail, and which illustrate its operation. The control valve 38 includes a housing 72 and an actuator 74. The inlet ports 56 and 58 and the outlet ports 60 and 62 may be positioned in a linear arrangement on the housing 72, and may be in the order shown in the Figures, whereby the first and second inlet ports 56 and 58 are positioned inside the first and second outlet ports 60 and 62. The housing 72 defines an internal passage 76 with which all of the ports 56, 58, 60 and 62 communicate. The housing 72 has a first end 78. The internal passage 76 has a first vent 80 in the first end 78. The housing 72 has a second end 82 in which there is positioned a second vent 84 for the internal passage 76.

The actuator 74 is moveable within the internal passage 76 to direct the flow of air into and out of the control valve 38. The actuator 74 includes a first seal 86, a second seal 88, and a third seal 90. When the control valve 38 is in a first control valve position, as shown in FIG. 3*a*, the first seal 86 is positioned between the first inlet port 56 and the first outlet port 60, thereby preventing them from communicating with each other. Furthermore, the first outlet port 60 is in fluid communication with the first vent 80. Because the first outlet port 60 is also in fluid communication with the portion of the pneumatic cylinder housing 44 in front of the piston 46, this portion of the housing 44 is at substantially atmospheric pressure.

In the first control valve position shown in FIG. 3*a*, the second and third seals 88 and 90 are positioned to form a chamber with which the second inlet port 58 and the second outlet port 62 communicate. Thus, in this position, air from the outlet of the second regulator 42 is transmitted to the portion of the pneumatic cylinder housing 44 behind the piston 46. This, in turn, causes the piston 46 to move to its forwardmost position, as shown in FIG. 1*a*. This, in turn, causes the bolt 16 to move to the closed position, as shown in FIG. 1*a*.

Reference is made to FIG. 3*b*, which shows the control valve 38 in a second control valve position. In the second control valve position, the actuator 74 is moved so that the third seal 90 is positioned between the second inlet port 58 and the second outlet port 62, thus preventing them from communicating with each other. Furthermore, in the position shown in FIG. 3*b*, the second outlet port 62 is in fluid communication with the second vent 84, which in turn causes the portion of the pneumatic cylinder housing 44 behind the piston 46 to be at substantially atmospheric pressure.

Furthermore, the first and second seals 86 and 88 cooperate to define a chamber around the first inlet port 56 and the first outlet port 60, permitting them to be in fluid communication with each other. Thus, in the position shown in FIG. 3*b* air from the outlet of the first regulator 40 is transmitted to the portion of the pneumatic cylinder housing 44 in front of the piston 46, which drives the piston 46 to its rearwardmost position, as shown in FIG. 1*b*.

Referring to FIG. 1*a*, when it is desired to fire the paintball marker 10, a trigger 92 that is positioned on the body 14, is pulled. Pulling of the trigger 92 causes pressurized air to be released through the outlet 35*a* in the bolt 16, to fire the chambered paintball 12 from the barrel 28. The linkage between the trigger 92 and the firing mechanism is not shown, and any suitable type of linkage may be used. The linkage may be mechanical, pneumatic, hydraulic, electrical, electronic or any combination thereof.

The firing mechanism itself is largely not shown, except for the outlet 35*a* in the bolt 16. The firing mechanism itself is not limited to any particular configuration for the purposes of this invention.

The trigger 92 is operatively connected to the actuator 18, and more specifically to the control valve actuator 74 (FIGS. 3*a* and 3*b*). The connection may be by any suitable means, such as, for example, a mechanical linkage (not shown), a pneumatic connection (not shown), an electrical connection (not shown), an electronic connection (not shown), or any combination thereof. Pulling of the trigger 92 causes firing of the chambered paintball 12 as described above, and then causes movement of the actuator 74 between the first control valve position (see FIG. 3*a*) and the second control valve position (see FIG. 3*b*). The actuator 74 may extend out of the housing 72 (see FIGS. 3*a* and 3*b*) for operatively connecting to the trigger 92.

The paintball marker 10 shown in the embodiment in FIGS. 1*a* and 1*b* is a "closed bolt" configuration, because the bolt 16 remains in the closed position (shown in FIG. 1*a*) when the trigger 92 is at rest. It is alternatively possible, however, for a paintball marker within the scope of this invention to have an open-bolt configuration, whereby the bolt remains in the open position when the trigger is at rest. In that case, when the trigger is pulled, the bolt closes with a closing force that is sufficiently low so as to inhibit rupturing of the paintball. Once in the closed position, the paintball that has been chambered is held between the bolt and the barrel. At this point, pressurized air is released to fire the paintball from the barrel.

Figure 4A:
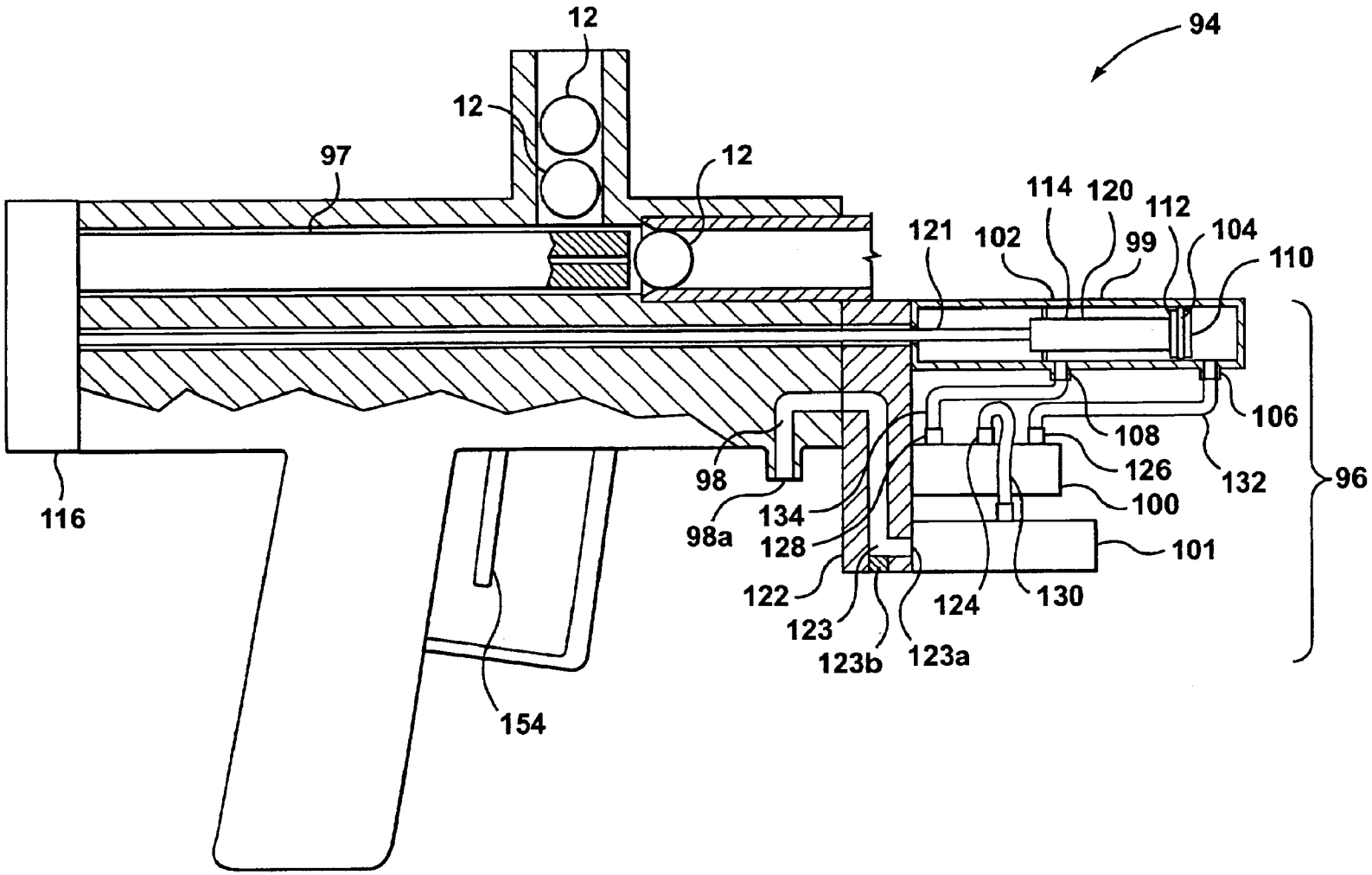
FIG. 4*a* is a partially sectional side view of a paintball marker in accordance with a second embodiment of the present invention, in a bolt-closed position.

Reference is made to FIG. 4*a*, which shows a paintball marker 94 in accordance with another embodiment of the present invention. The paintball marker 94 may be similar to the paintball marker 10, except that the paintball marker 94 incorporates an actuator 96 instead of the actuator 18 (see FIG. 1*a*).

Figure 4B:
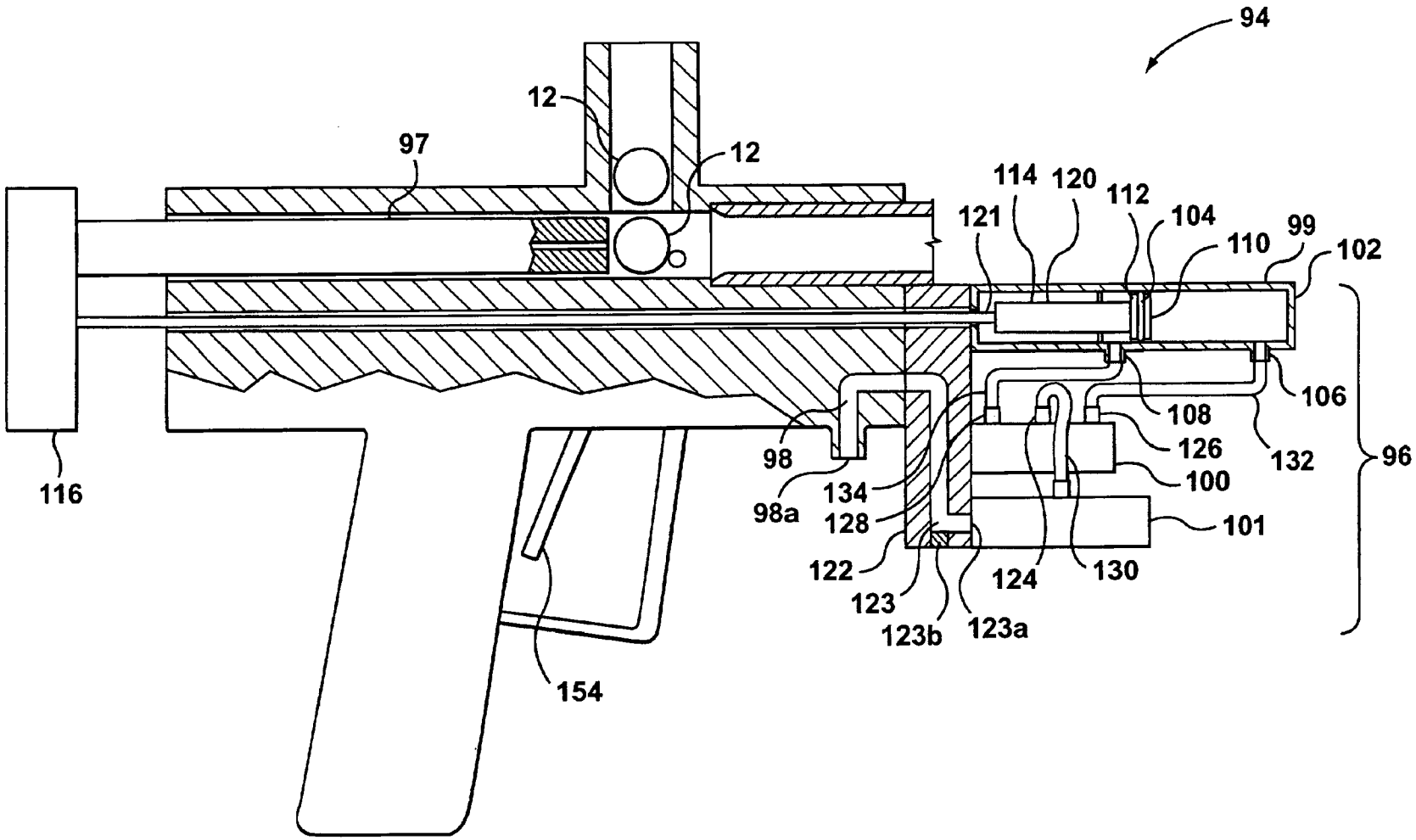
FIG. 4*b* is a partially sectional side view of the paintball marker shown in FIG. 4*a*, in a bolt-open position.

In similar fashion to the actuator 18 (FIG. 1*a*), the actuator 96 may utilize air pressure from a pressurized air tank (not shown), to drive a bolt 97 between open and closed positions (FIGS. 4*b* and 4*a* respectively). A primary regulator (not shown) may be connected to the air tank to reduce the air pressure from the air tank down to a pressure suitable for use in firing the paintball marker 94. The primary regulator (not shown) may be a single stage regulator, or alternatively may be a dual stage regulator, essentially consisting of two regulators in series to reduce the air pressure in two stages down to the firing pressure. The marker 94 includes an air conduit 98 for transporting air from the primary regulator (not shown) through an inlet 98*a*, to the firing mechanism (not shown) and to the actuator 96.

The actuator 96 includes a pneumatic cylinder 99, a control valve 100 and an actuator regulator 101. The pneumatic cylinder 99 includes a housing 102 and a piston 104. The housing 102 may be similar to the pneumatic cylinder housing 44 (see FIG. 1*a*), and may have a first port 106 proximate its front end and a second port 108 proximate its rear end. The piston 104 is moveable within the housing 102 between a forwardmost position as shown in FIG. 4*a*, and a rearwardmost position, as shown in FIG. 4*b*.

The piston 104 has a front face 110 and a rear face 112. A rod 114 may be connected at a first end to the rear face 112 of the piston 104, and at a second end to a back plate 116. The back plate 116 may, in turn, be connected to the bolt 97. The rod 114 may be a two stage rod, and may have a front portion 120 and a rear portion 121. The front portion 120 is connected to the rear face 112 of the piston 104, and extends out of the rearwardmost end of the pneumatic cylinder housing 102. Thus, the pressure bearing surface area of the rear face 112 is smaller than the pressure bearing surface area of the front face 110, because of the surface area occupied on the rear face 112 by the front portion 120 of the rod 114. For example, if the front portion 120 of the rod 114 is generally cylindrical, the pressure bearing surface area on the rear face 112 will be an annulus having a surface area that is equal to the overall surface area of the rear face 112 minus the cross-sectional area of the front portion 120. It will be noted that, the front portion 120 of the rod 114 extends out of the housing 102, throughout the range of motion of the piston 104. This provides a constant pressure bearing surface area on the rear face 112 of the piston 104, that is smaller than that of the front face 110. The pressure bearing surface areas on the rear and the front faces 112 and 110 are discussed further below.

The rear portion 121 has been described as being smaller in diameter than the front portion 120. It is alternatively possible for a rod to be provided wherein the rear portion is the same diameter as the front portion (ie. whereby the entire rod is of a constant diameter, and is suited to occupy a selected portion of the surface area on the rear face 112 of the piston 104). However, it is not necessary for the entire rod to be of a constant diameter.

The actuator regulator 101 is mounted in fluid communication with the air conduit 98 to receive air from the primary regulator (not shown). More specifically, the paintball marker 94 may include a manifold 122 that has an internal air conduit 123 therein that is in fluid communication with the air conduit 98.

The manifold 122 has a first port 123*a* for connection to the actuator regulator 101. The manifold 122 may optionally also include a second port 123*b*, which may be used as desired, or which may be plugged when not in use. It is alternatively possible for the primary regulator (not shown) to be connected directly into the manifold 122 using the optional port 123*b*, instead of being connected to the air conduit inlet 98*a*. In that case, it will be appreciated that the inlet 98*a* would require plugging.

The control valve 100 controls the movement of the piston 104 by controlling the flow of air from the regulator 101 to the first and second ports 106 and 108 on the pneumatic cylinder 99. The control valve 100 has a single inlet port 124, a first outlet port 126 and a second outlet port 128. The inlet port 124 is connected to the regulator 101 by means of a first conduit 130. The first outlet port 126 is connected to the first port 106 on the pneumatic cylinder 99 by means of a second conduit 132. The second outlet port 128 is connected to the second port 108 on the pneumatic cylinder 99 by means of a third conduit 134.

Figure 5A:
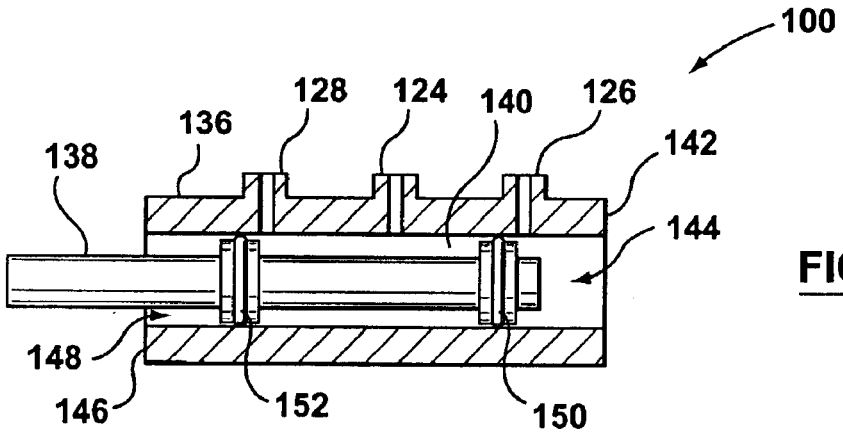
FIGS. 5*a* and 5*b* are magnified sectional side views of a control valve for use with the paintball marker shown in FIG. 4*a;*
Figure 5B:
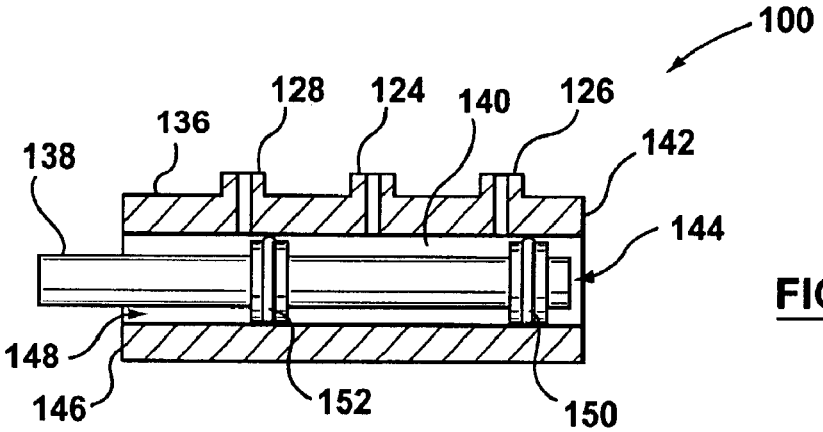

Reference is made to FIGS. 5*a* and 5*b* which show the control valve 100 in more detail, and which illustrate its operation. The control valve 100 includes a housing 136 and an actuator 138. The housing 136 defines an internal passage 140 therethrough. The inlet port 124 and the first and second outlet ports 126 and 128 each communicate with the internal passage 140 and are arranged in a linear orientation on the housing 136, with the inlet port 124 positioned between the two outlet ports 126 and 128. The housing 136 has a first end 142 in which is positioned a first vent 144. The housing 136 has a second end 146 in which is positioned a second vent 148. The actuator 138 includes a first seal 150 and a second seal 152. In a first control valve position, which is shown in FIG. 5*a*, the first seal 150 is positioned between the inlet port 124 and the first outlet port 126, so that fluid communication between these two ports is prevented. Furthermore, the first outlet port 126 is in fluid communication with the first vent 144, which causes the portion of the pneumatic cylinder housing 102 in front of the piston 104 to be at substantially atmospheric pressure (see FIG. 4*a*). The first and second seals 150 and 152 cooperate to define a chamber around the inlet port 124 and the second outlet port 128. In doing so, the control valve 100 transmits air from the regulator 101 to the portion of the pneumatic cylinder housing 102 behind the piston 104, which drives the piston 104 to its forwardmost position, as shown in FIG. 4*a*.

Reference is made to FIG. 5*b*, which shows the control valve 100 in a second control valve position. In this position, the second seal 152 is positioned between the inlet port 124 and the second outlet port 128, preventing them from communicating with each other. Furthermore, the second outlet port 128 is in fluid communication with the second vent 148, and consequently the portion of the pneumatic cylinder housing 102 behind the piston 104 is at substantially atmospheric pressure (see FIG. 4*b*). Furthermore, the first and second seals 150 and 152 cooperate to define a chamber around the inlet port 124 and the first outlet port 126, so that air is transmitted from the actuator regulator 101 to the portion of the pneumatic cylinder housing in front of the piston 104 (see FIG. 4*b*).

The movement of the actuator 138 between the first and second control valve positions may be initiated by moving a trigger 154 which may be connected to the actuator 138 by any suitable means (not shown). The connection means may be mechanical, pneumatic, hydraulic, electrical, electronic, or any combination thereof.

It will be noted that in the embodiment shown in FIGS. 4*a* and 4*b*, the same air pressure is used to actuate the piston 104 in both directions, i.e. towards its forwardmost position and towards its rearwardmost position. However, because the pressure bearing surface area of the rear face 112 of the piston 104 is smaller than that of the front face 110, the force with which the piston 104 is driven towards its forwardmost position is smaller than the force with which the piston 104 is driven towards its rearwardmost position. The pressure bearing surface area on the rear face 112 may be selected so that the force with which the bolt 97 is moved towards the closed position is low enough to inhibit the rupturing of a paintball 12 in the event of a paintball mis-feed.

Figure 6:
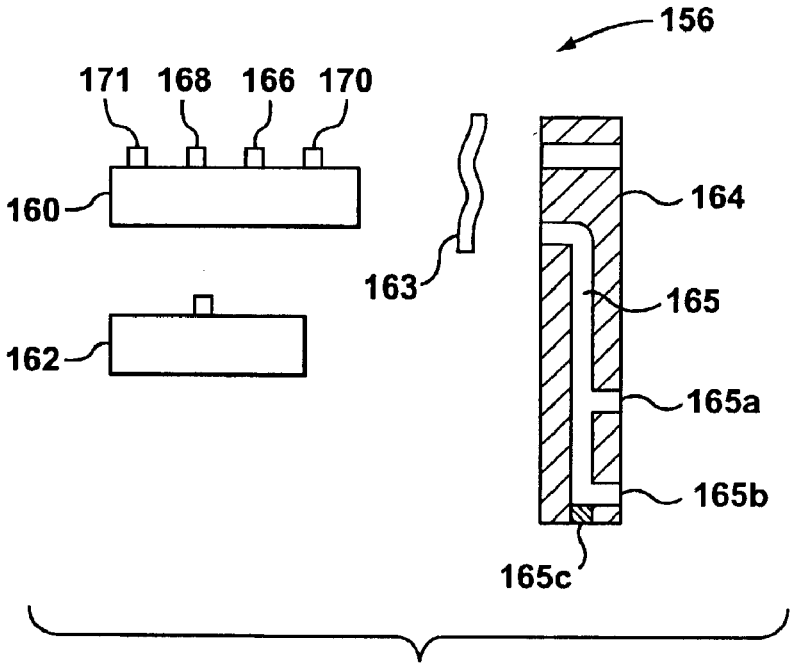
FIG. 6 is a kit of parts in accordance with another embodiment of the present invention for retrofit to a paintball marker of the prior art.
Figure 7:
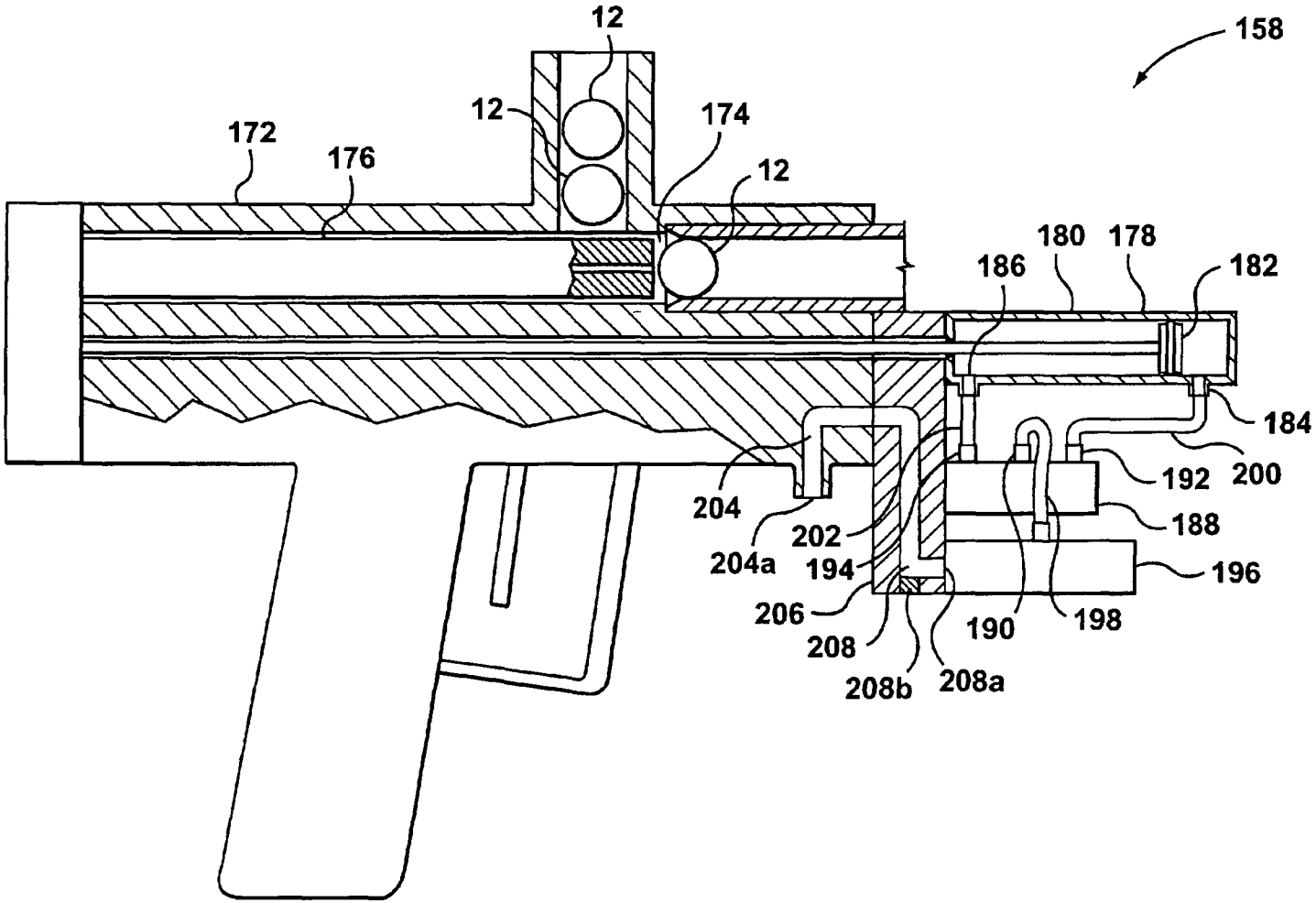
FIG. 7 (Prior Art)
FIG. 7 is a paintball marker of the prior art.

Reference is made to FIGS. 6 and 7. A kit of parts 156 is shown in FIG. 6, in accordance with another embodiment of the present invention. The kit of parts 156 can be retrofitted to a paintball marker 158 of the prior art, as shown in FIG. 7, to provide the paintball marker 158 with a reduced tendency for rupturing paintballs during bolt closure. The kit of parts 156 includes a control valve 160, a regulator 162, a conduit 163 and a manifold 164.

The control valve 160 may be similar to the control valve 38 in the embodiment shown in FIG. 1*a*. The control valve 160 includes a first inlet port 166, a second inlet port 168, a first outlet port 170 and a second outlet port 171.

The regulator 162 may be similar to the regulator 42 in the embodiment shown in FIG. 1*a*. The regulator 162 may be configured to produce an outlet pressure of approximately 10–50 psi.

The manifold 164 may be similar to the manifold 54 in the embodiment shown in FIG. 1*a*. The manifold 164 has an air conduit 165 therein, and has a first port 165*a* and a second port 165*b* in communication with the air conduit 165. The manifold 164 may also have a third port 165*c* in communication with the air conduit 165.

Referring to FIG. 7, the paintball marker 158 of the prior art includes a body 172 that defines a chamber 174 for holding a paintball 12 to be fired. A bolt 176 is slideable within the chamber 174, between a closed position, as shown in FIG. 7, and an open position (not shown).

A pneumatic cylinder 178 is operatively connected the bolt 176 for moving the bolt 176 between the open and closed positions. The pneumatic cylinder 178 includes a housing 180 and a piston 182. The housing 180 has a first port 184 and a second port 186.

A control valve 188 is used to control the movement of the piston 182 in the pneumatic cylinder 178. The control valve 188 may be similar to the control valve 100 in the embodiment shown in FIG. 4*a*, and includes an inlet port 190, a first outlet port 192 and a second outlet port 194. The inlet port 190 is connected to the outlet of a pressure regulator 196 by means of a first conduit 198. The first outlet port 192 is connected to the first port 184 on the pneumatic cylinder 178 by means of a second conduit 200. The second outlet port 194 is connected to the second port 186 on the pneumatic cylinder 178 by means of a third conduit 202.

The control valve 188 is used to direct air from the regulator 196 to either of the two ports 184 and 186 on the pneumatic cylinder 178. Thus, the same air pressure is used to drive the piston 182 in both directions, i.e., towards its forwardmost position, and towards its rearwardmost position. The pressure bearing surface area of the piston 182 is substantially the same on both its front face and its rear face, and as a result, the force exerted on the piston 182 by the air is substantially the same in both directions.

The paintball marker 158 may be connectable to a pressurized air tank (not shown) and a primary regulator (not shown) through an air conduit 204 which has an inlet 204*a*, and in turn, through a manifold 206, which has an air conduit 208 that is in communication with the air conduit 204. The manifold 206 has a first port 208*a*, which communicates pressurized air from the primary regulator (not shown) to the actuator regulator 196. The manifold 206 may have a second port 208*b*, which is typically plugged. The manifold 206 may be removable from the body 172 of the marker 158.

In order to prepare the paintball marker 158 for retrofit with the kit of parts 156, the control valve 188 is removed from the paintball marker 158. The manifold 196 may be removed from the paintball marker 158. The conduits 198, 200, and 202 are not required to be removed from the regulator 196 and the pneumatic cylinder 178, respectively.

The manifold 164 may be mounted to the body 172 so that the manifold air conduit 165 is in fluid communication with the air conduit 204. The control valve 160 (FIG. 6) may be attached to the manifold 164, or alternatively to the body 172. The regulators 196 and 162 and the pneumatic cylinder 178 may be mounted to the manifold 164. Alternatively, some or all of these components may be mounted to the body 172. However, the regulators 196 and 162 are to be mounted in any case so that they are each in fluid communication with the air conduit 165, eg. through the ports 165*a* and 165*b*.

Figure 8:
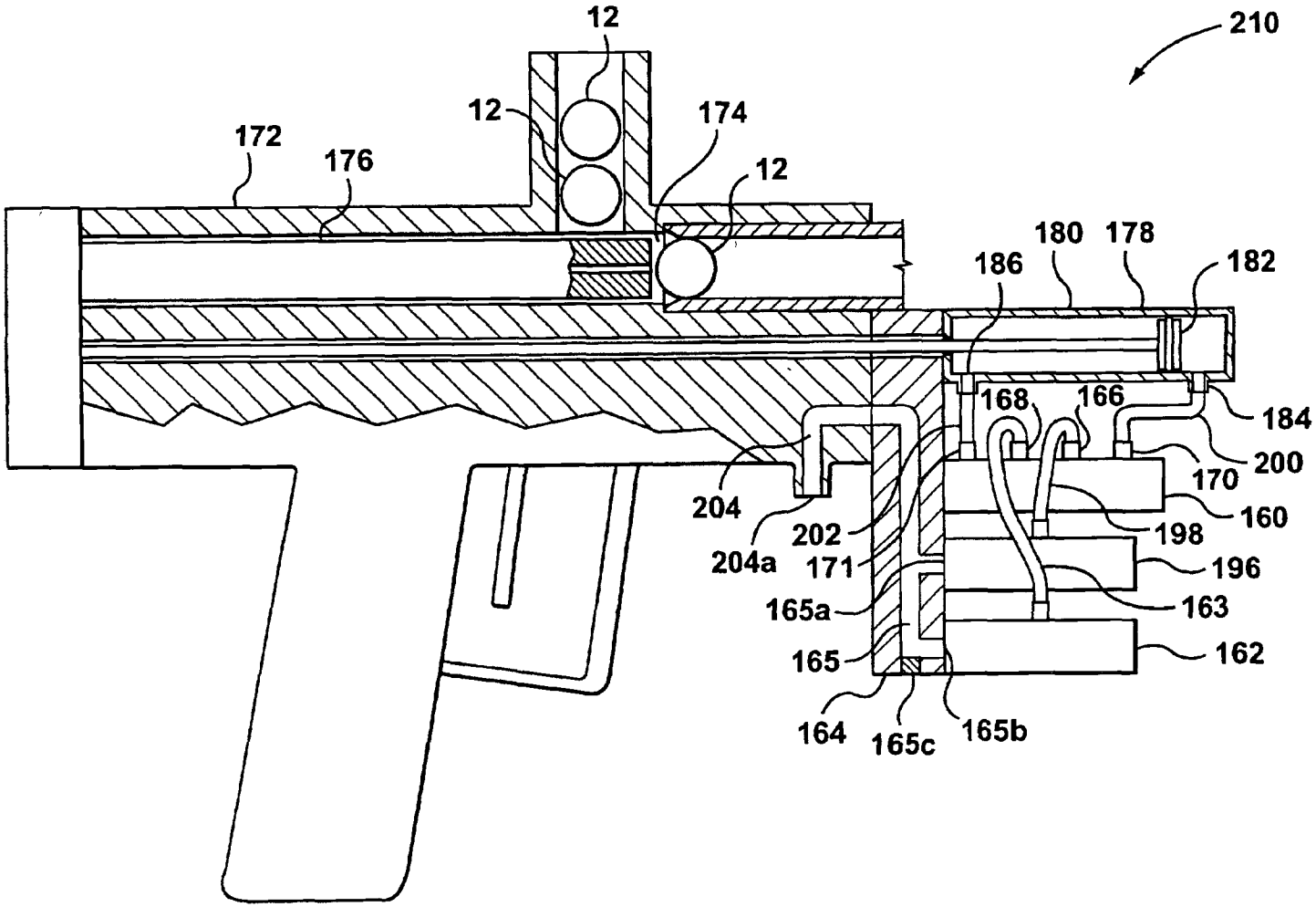
FIG. 8 is a paintball marker derived from retrofitting the kit of parts of FIG. 6 to the paintball marker of FIG. 7.

Reference is made to FIG. 8, which shows a paintball marker 210, which is the paintball marker 158 of FIG. 7 retrofitted with the kit of parts 156 of FIG. 6. The conduit 198 leading from the regulator 196 may be connected to the first inlet port 166. The conduit 200 leading from the first port 184 on the pneumatic cylinder 178 may be connected to the first outlet port 170. The conduit 202 leading from the second port 186 on the pneumatic cylinder 178 may be connected to the second outlet port 171. The outlet of the regulator 162 may be connected to the second inlet port 168 on the control valve 160 by means of the conduit 163. Once the above steps are completed, the paintball marker 158 of the prior art (FIG. 7) has been converted into the paintball marker 210. The control valve 160 controls the actuation of the pneumatic cylinder 178, instead of the control valve 188 (FIG. 7). Similarly to the control valve 38 in the embodiment shown in FIG. 1*a*, the control valve 160 directs air from the regulator 162 to drive the piston 182 towards its forwardmost position, and directs air from the regulator 196 to drive the piston 182 towards its rearwardmost position. Because the regulator 162 provides air at a lower pressure than the regulator 196, the force with which the bolt 176 closes is less than the force with which the bolt 176 opens. The pressure of the air provided by the regulator 162 may be selected to inhibit rupturing of paintballs 12 in the event that the bolt 176 jams against a paintball 12 during bolt closure.

Optionally, the kit of parts 156 of FIG. 6 may be provided with enough conduit to replace the conduits 198, 200 and 202. The conduits 198, 200 and 202 may require replacement if they are damaged during disconnection from the control valve 188 and from the regulator 196. The conduit provided with the kit of parts 156 may be cut into separate lengths configured to replace the conduits 198, 200 and 202, as well as a length for the conduit 163. Alternatively, the conduit provided with the kit of parts 156 may be a single length of conduit that the user can cut as desired to provide the conduit 163 and to replace whichever of the conduits 198, 200 and 202 require replacement, if any. As another option, the kit of parts 156 of FIG. 6 may lack any conduits, with the expectation that any conduits that are required may be supplied by the user who acquires the kit of parts 156 for retrofit it to the marker 158.

In the case where the existing manifold 206 (FIG. 7) on the paintball marker 158 of the prior art, includes the second port 208*b* (FIG. 7), the manifold 164 (FIG. 6) is not required to be included in the kit of parts 156 (FIG. 6). This is because the second regulator 162 (FIG. 6) may be connected into the port 208*b* (FIG. 6) on the existing manifold 206 (FIG. 6). In this case, it is not important whether the existing manifold 206 (FIG. 6) is a separate piece that is removable from the paintball marker 158 (FIG. 7) or is integral with the body 172 (FIG. 7) of the marker 158 (FIG. 6).

Furthermore, the second regulator 162 (FIG. 8) has been described as being connected to a second port 165*b* (FIG. 8) or 208*b* (FIG. 7) that is provided on the manifold 164 (FIG. 8) or 206 (FIG. 7), so that the second regulator 162 (FIG. 8) is in fluid communication with the pressurized air from the primary regulator (not shown). It is not important how the second regulator 162 (FIG. 8) is made to be in communication with the pressurized air. It may be by any means. For example, in cases (not shown) where the second manifold, t does not include a second port, it is possible that the user may be instructed to machine a second port into the manifold for receiving the second regulator 162 (FIG. 8). Thus, in this instance, the new manifold 164 (FIG. 6) may be omitted from the kit of parts 156 (FIG. 6).

Referring to FIG. 6, the regulator 162 has been described as being included as part of the kit of parts 156. It is alternatively possible for the kit of parts 156 to not have a regulator for providing air at a second pressure. Instead, the user may be instructed to provide an equivalent to the regulator 162, and to connect it to the marker 158 to provide air at the second pressure, eg. 10–50 psi.

Figure 9:
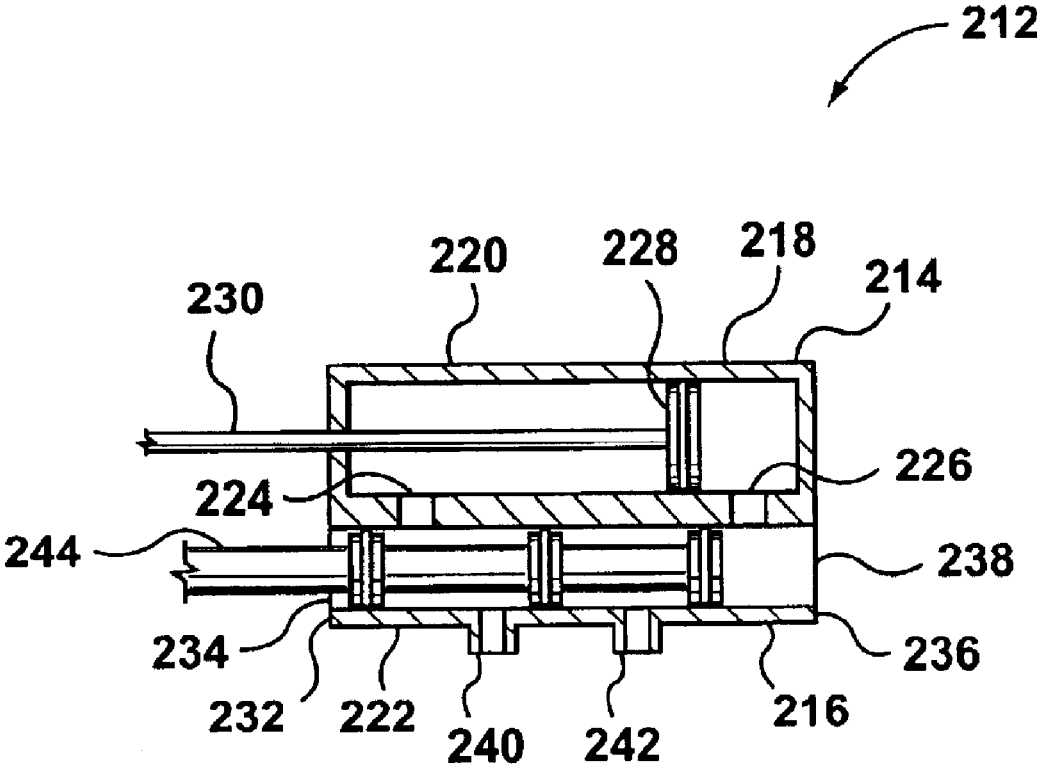
FIG. 9 is a magnified sectional side view of a combined cylinder/control valve unit that may be incorporated into the paintball markers shown in FIGS. 1*a* and 8.

Reference is made to FIG. 9, which shows a combined unit 212, having therein a pneumatic cylinder 214 and a control valve 216. The combined cylinder/valve unit 212 may be used to replace the pneumatic cylinder 37 and the control valve 38 in the embodiment of the invention shown in FIG. 1*a*. Furthermore, it is possible that the combined cylinder/valve unit 212 may be included as part of the kit of parts 156 shown in FIG. 6, instead of the control valve 160. Referring to FIG. 7, the pneumatic cylinder 178 and the control valve 188 would, in this case, be removed from the paintball marker 158 and replaced by the combined unit 212. The connection means between the trigger and the control valve 216 may, in this case, require some reconfiguring due to the new positioning of the control valve 216, relative to the position of the original control valve 188.

The combined unit 212 has a body 218. The body 218 has a first portion 220 that serves as a cylinder housing, and a second portion 222 that serves as a control valve housing. A first port 224 and a second port 226 permit fluid communication between the cylinder housing 220 and the control valve housing 222. The first and second ports 224 and 226 serve as first and second outlet ports from the control valve 216, and also serve as first and second inlet ports for the cylinder 214.

A piston 228 is positioned in the cylinder housing 220. The piston 228 is moveable in the cylinder housing 220 between the first and second ports 224 and 226, based on the entry and discharge of pressurized air through the first and second ports 224 and 226. A rod 230 extends from the piston and may be connected directly or indirectly to a back plate on a paintball marker of the present invention.

The control valve housing 222 has a first end 232 in which there is a first vent 234, and a second end 236 in which there is a second vent 238. The first and second vents 234 and 238 permit pressurized air in the cylinder 214 to discharge as required during movement of the piston 228.

The control valve housing 222 has a first inlet port 240 and a second inlet port 242. The inlet ports 240 and 242 are positioned generally centrally, and may be circumferentially opposed to the first and second outlet ports 224 and 226, to facilitate connection to other components, such as conduits for pressurized air.

An actuator 244, which may be similar to the actuator 74, is positioned in the control valve housing 222. The actuator 244 is moveable within the control valve housing 222 to permit fluid communication between either the first inlet and outlet ports 240 and 224, or between the second inlet and outlet ports 242 and 226. If the first inlet and outlet ports 240 and 224 are permitted to communicate, eg. in the control valve position shown in FIG. 9, the second outlet port 226 is in fluid communication with the second vent 238. If the second inlet and outlet ports 242 and 226 are permitted to communicate (not shown), the first outlet port 224 is in fluid communication with the first vent 234. In this way, when the portion of the cylinder housing 220 behind the piston 228 is being charged with pressurized air, the portion of the cylinder housing 220 in front of the piston 228 is venting pressurized air, and vice versa.

It has been described that the combined cylinder/control valve unit 212 could be provided with the paintball marker 10 (FIG. 1*a*) and the kit of parts 156 (FIG. 6). It is alternatively possible to have a similar combined cylinder/control valve unit (not shown) that would be an analogous combination of the pneumatic cylinder 99 and the control valve 100 (FIG. 4*a*). In that instance, the cylinder would include first and second ports which would communicate with the control valve, however, the control valve would include a single inlet port, since the unit would not require inlet air at two different pressures to operate.

In all of the embodiments described above, particular examples of control valve have been provided. It will be noted that any suitable type of control valve may be used instead of those described above.

In all of the embodiments described above, the opening force with which the bolt is moved towards its open position is greater than the closing force with which the bolt is moved towards its closed position. This is because there is no risk of pinning and rupturing a paintball as the bolt moves towards its open position. It is alternatively possible, however, for the bolt to move towards its open position with the same degree of force as it uses to move towards its closed position. It is, however, quicker for the bolt to move to the open position using a greater force than that which is used to move the bolt to its closed position.

In the embodiments shown in FIGS. 1*a* and 8, the markers 10 and 210 have two regulators, one of which provides a higher pressure for opening the bolt, and one of which provides a lower pressure for closing the bolt. It is alternatively possible for the markers 10 and 210 to have a single regulator (not shown) that has two outputs, one output at a higher pressure and one output at a lower pressure, to replace the two separate regulators included in the markers 10 and 210.

In each of the embodiments described above, the outputs of the control valves have been shown to be connected to the ports on the pneumatic cylinder in a certain way. It is alternatively possible for the connections between the ports on the control valve and the ports on the pneumatic cylinder to be reversed, so that the control valve actuator would move forward to effect forward movement of the piston, and the control valve actuator would move rearward to effect rearward movement of the piston. Such a configuration may be used, depending on the mechanism connecting the trigger to the control valve.

Reference has been made throughout this description to an air tank and to using air to operate the actuators in accordance with the present invention. It will be appreciated that any suitable gas may be used instead of air, to operate the actuators of the embodiments described herein.

While the above description constitutes the preferred embodiments, it will be appreciated that the present invention is susceptible to modification and change without departing from the fair meaning of the accompanying claims.

What is claimed is:

1. A paintball marker comprising:

a body, said body defining a chamber, said chamber having a paintball inlet;

a bolt, wherein said bolt is slideable within said chamber between an open position wherein said bolt permits entry of a paintball through said paintball inlet into said chamber and a closed position wherein said bolt prevents entry of a paintball through said paintball inlet into said chamber; and an actuator, wherein said actuator is operatively connected to said bolt, and wherein said actuator is adapted to apply an opening force to move said bolt towards said open position and a closing force to move said bolt towards said closed position, and wherein said opening force is different from said closing force, wherein said actuator includes a pneumatic cylinder, said pneumatic cylinder includes a cylinder housing, said cylinder housing includes a first cylinder port and a second cylinder port, and wherein said pneumatic cylinder further includes a piston, and said piston is slideable within said cylinder housing between said first and second cylinder ports, and wherein said actuator includes a control valve for controlling gas flow to said first and second cylinder ports, and wherein said control valve is adapted to send gas at a first pressure to said first cylinder port to move said piston in a first direction and said control valve is adapted to send gas at a second pressure to said second cylinder port to move said piston in a second direction.

2. A paintball marker as claimed in claim 1, wherein said actuator further includes a first regulator, said first regulator is fluidly connectable to a gas source, said first regulator is adapted to reduce pressure of said gas to said first pressure, and said first regulator is fluidly connected to and upstream from said control valve, and wherein said actuator further includes a second regulator, said second regulator is fluidly connectable to said gas source, said second regulator is adapted to reduce pressure of said gas to said second pressure, and said second regulator is fluidly connected to and upstream from said control valve, wherein said control valve is adapted to send gas from said first regulator to said first cylinder port and said control valve is adapted to send gas from said second regulator to said second cylinder port.

3. A paintball marker as claimed in claim 2, further comprising a manifold, wherein said manifold is adapted to be downstream from and in fluid communication with said pressurized gas source, and is upstream from and in fluid communication with said first and second regulators.

4. A paintball marker as claimed in claim 3, wherein said manifold is separate from and mounted to said body.

5. A paintball marker as claimed in claim 1, wherein said control valve and said pneumatic cylinder are connected to each other to form a combined cylinder/control valve unit.

6. A paintball marker as claimed in claim 5, wherein said control valve and said pneumatic cylinder are integrally connected to each other.

7. An actuator for a paintball marker, said paintball marker including a body, said body defining a chamber, said chamber having a paintball inlet, said paintball marker further including a bolt, wherein said bolt is slideable within said chamber between an open position wherein said bolt permits entry of a paintball through said paintball inlet into said chamber and a closed position wherein said bolt prevents entry of a paintball through said paintball inlet into said chamber, said paintball marker further including a pneumatic cylinder, wherein said pneumatic cylinder is operatively connected to said bolt, the actuator comprising:

a control valve, wherein said control valve is positionable in a first control valve position wherein said control valve is adapted to transmit gas at a first pressure to said pneumatic cylinder for driving said bolt towards said open position, and said control valve is positionable in a second control valve position wherein said control valve is adapted to transmit gas at a second pressure to said pneumatic cylinder to drive said bolt towards said closed position, wherein said second pressure is different from said first pressure.

8. An actuator as claimed in claim 7, wherein said paintball marker further includes a first regulator, wherein said first regulator is fluidly connectable to a pressurized gas source and is adapted to provide gas at said first pressure, and said actuator further includes a second regulator, wherein said second regulator is fluidly connectable to said pressurized gas source and is adapted to provide gas at said second pressure.

9. An actuator as claimed in claim 8, wherein said control valve has a first valve inlet port that is adapted for receiving gas from said first regulator and a second valve inlet port that is adapted for receiving gas from said second regulator.

10. An actuator as claimed in claim 9, wherein said cylinder has a first cylinder port for receiving gas to drive said bolt towards said open position and a second cylinder port for receiving gas to drive said bolt towards said closed position, and wherein said control valve has a first outlet port that is adapted for sending gas received from said first regulator to said first cylinder port and a second outlet port that is adapted for sending gas received from said second regulator to said second cylinder port.

11. An actuator as claimed in claim 7, wherein said second pressure is less than said first pressure.

12. An actuator as claimed in claim 8, further comprising a manifold, wherein said manifold is mountable downstream from and, in fluid communication with said pressurized gas source, and upstream from and in fluid communication with said first and second regulators.

13. An actuator as claimed in claim 7, wherein said control valve is part of a combined cylinder/control valve unit, wherein said combined cylinder/control valve unit includes said pneumatic cylinder.

14. An actuator as claimed in claim 13, wherein said control valve and said pneumatic cylinder are integrally connected to each other.

15. A method for controlling flow of paintballs through a paintball inlet into a chamber defined in a body of a paintball marker, said paintball marker including a bolt, wherein said bolt is slideable within said chamber, the method comprising:

applying an opening force to said bolt to move said bolt to an open position to permit entry of a paintball through said paintball inlet into said chamber; and applying a closing force to said bolt to move said bolt to a closed position to prevent entry of a paintball through said paintball inlet into said chamber, wherein said closing force is less than said opening force.

16. A paintball marker comprising:

a body, said body defining a chamber, said chamber having a paintball inlet;

a bolt, wherein said bolt is slideable within said chamber between an open position wherein said bolt permits entry of a paintball through said paintball inlet into said chamber and a closed position wherein said bolt prevents entry of a paintball through said paintball inlet into said chamber; and a pneumatic cylinder, said pneumatic cylinder includes a cylinder housing, said cylinder housing includes a first cylinder port and a second cylinder port, and wherein said pneumatic cylinder further includes a piston, and said piston is slideable within said cylinder housing between said first and second cylinder ports, wherein said piston is operatively connected to said bolt; and a control valve for controlling gas flow to said first and second cylinder ports, wherein said control valve is adapted to send gas to said first cylinder port to move said piston in a first direction to move said bolt towards said open position with an opening force and said control valve is adapted to send gas to said second cylinder port to move said piston in a second direction to move said bolt towards said closed position with a closing force, wherein said closing force is below a selected value to inhibit rupturing of a paintball if, during use, said paintball is confined by said bolt during movement of said bolt towards said closed position, and wherein said control valve is adapted to send gas at a first pressure to said first cylinder port to move said piston in said first direction and said control valve is adapted to send gas at a second pressure to said second cylinder port to move said piston in said second direction.

17. A paintball marker as claimed in claim 16, further comprising a first regulator, said first regulator is fluidly connectable to a gas source, said first regulator is adapted to reduce pressure of said gas to said first pressure, and said first regulator is fluidly connected to and upstream from said control valve, and wherein said paintball marker further includes a second regulator, said second regulator is fluidly connectable to said gas source, said second regulator is adapted to reduce pressure of said gas to said second pressure, and said second regulator is fluidly connected to and upstream from said control valve.

18. A paintball marker comprising:

a body, said body defining a chamber, said chamber having a paintball inlet;

a bolt, wherein said bolt is slideable within said chamber between an open position wherein said bolt permits entry of a paintball through said paintball inlet into said chamber and a closed position wherein said bolt prevents entry of a paintball through said paintball inlet into said chamber; and a pneumatic cylinder, said pneumatic cylinder includes a cylinder housing, said cylinder housing includes a first cylinder port and a second cylinder port, and wherein said pneumatic cylinder further includes a piston, and said piston is slideable within said cylinder housing between said first and second cylinder ports, wherein said piston is operatively connected to said bolt; and a control valve for controlling gas flow to said first and second cylinder ports, wherein said control valve is adapted to send gas to said first cylinder port to move said piston in a first direction to move said bolt towards said open position with an opening force and said control valve is adapted to send gas to said second cylinder port to move said piston in a second direction to move said bolt towards said closed position with a closing force, wherein said closing force is below a selected value to inhibit rupturing of a paintball if, during use, said paintball is confined by said bolt during movement of said bolt towards said closed position, wherein said control valve and said pneumatic cylinder are connected to each other to form a combined cylinder/control valve unit, wherein said control valve and said pneumatic cylinder are integrally connected to each other.

19. A paintball marker comprising:

a body, said body defining a chamber, said chamber having a paintball inlet;

a bolt, wherein said bolt is slideable within said chamber between an open position wherein said bolt permits entry of a paintball through said paintball inlet into said chamber and a closed position wherein said bolt prevents entry of a paintball through said paintball inlet into said chamber; and an actuator, wherein said actuator is operatively connected to said bolt, said actuator is adapted to apply a closing force to move said bolt towards said closed position, wherein said closing force is below a selected value, wherein said actuator includes a pneumatic cylinder, said pneumatic cylinder includes a cylinder housing, said cylinder housing includes a first cylinder port and a second cylinder port, and wherein said pneumatic cylinder further includes a piston, and said piston is slideable within said cylinder housing between said first and second cylinder ports, and wherein said actuator includes a control valve for controlling gas flow to said first and second cylinder ports, and wherein said control valve is adapted to send gas at a first pressure to said first cylinder port to move said piston in a first direction and said control valve is adapted to send gas at a second pressure to said second cylinder port to move said piston in a second direction.

20. A paintball marker as claimed in claim 19, wherein said actuator further includes a first regulator, said first regulator is fluidly connectable to a gas source, said first regulator is adapted to reduce pressure of said gas to said first pressure, and said first regulator is fluidly connected to and upstream from said control valve, and wherein said actuator further includes a second regulator, said second regulator is fluidly connectable to said gas source, said second regulator is adapted to reduce pressure of said gas to said second pressure, and said second regulator is fluidly connected to and upstream from said control valve, wherein said control valve is adapted to send gas from said first regulator to said first cylinder port and said control valve is adapted to send gas from said second regulator to said second cylinder port.

21. A paintball marker as claimed in claim 20, wherein said piston has a first face, said first face is adapted to be exposed to gas pressure from gas at said first cylinder port, and said first face has a first pressure bearing surface area, and wherein said piston has a second face, said second face is adapted to be exposed to gas pressure from gas at said second cylinder port, and said second face has a second pressure bearing surface area, wherein said second pressure bearing surface area is different from said first pressure bearing surface area.

22. A paintball marker as claimed in claim 21, wherein said second pressure bearing surface area is smaller than said first pressure bearing surface area.

23. A paintball marker as claimed in claim 19, wherein said control valve and said pneumatic cylinder are connected to each other to form a combined cylinder/control valve unit.

24. A paintball marker as claimed in claim 23, wherein said control valve and said pneumatic cylinder are integrally connected to each other.

* * * * *